US006860773B2

(12) United States Patent
Carmichael

(10) Patent No.: US 6,860,773 B2
(45) Date of Patent: Mar. 1, 2005

(54) INFLATABLE DIVE MARKER AND COLLECTION BAG

(76) Inventor: Robert M. Carmichael, 940 NW. 1st St., Fort Lauderdale, FL (US) 33311

( * ) Notice: Subject to any disclaimer, the term of this patent is extended or adjusted under 35 U.S.C. 154(b) by 0 days.

(21) Appl. No.: 10/718,788

(22) Filed: Nov. 21, 2003

(65) Prior Publication Data

US 2004/0116010 A1 Jun. 17, 2004

Related U.S. Application Data

(63) Continuation of application No. 09/803,868, filed on Mar. 12, 2001, now Pat. No. 6,652,339, which is a continuation-in-part of application No. 09/049,648, filed on Mar. 27, 1998, now Pat. No. 6,200,026.

(60) Provisional application No. 60/042,201, filed on Mar. 31, 1997.

(51) Int. Cl.[7] ..... B63B 22/16

(52) U.S. Cl. ..... 441/6; 441/16; 441/28; 441/30

(58) Field of Search ..... 441/1, 6, 28, 30, 441/32, 11, 13, 16, 20

(56) References Cited

U.S. PATENT DOCUMENTS

| | | | | | |
|---|---|---|---|---|---|
| 3,149,352 | A | * | 9/1964 | Christiansen | 441/11 |
| 3,613,097 | A | * | 10/1971 | Daughenbaugh | 342/10 |
| 5,179,907 | A | * | 1/1993 | Galbraith | 116/209 |
| 5,609,122 | A | * | 3/1997 | Jimmie | 116/173 |
| 5,735,719 | A | * | 4/1998 | Berg | 441/11 |
| 6,162,106 | A | * | 12/2000 | Shieh | 441/30 |

* cited by examiner

*Primary Examiner*—Stephen Avila
(74) *Attorney, Agent, or Firm*—Daniel S. Polley, P.A.

(57) ABSTRACT

An inflatable diver marker and collection bag is disclosed which can be utilized by a diver for collecting lobster, conch, etc., as well as providing for a diver location marker to boats and other water vehicles traveling in the vicinity of the diver. The dive marker/collection bag also provides for an individual ascent line for the diver. The inflatable dive marker/collection bag allows the diver to send the collected items to the surface without the diver having to surface. In one embodiment, the shape of at least the bottom half of the collection bag is "bell" shaped to help prevent the collected items from escaping when additional items to the collection bag. Additional embodiments for a dive marker are also shown.

20 Claims, 8 Drawing Sheets

INFLATABLE DIVE MARKER AND COLLECTION BAG

This application is a continuation of U.S. application Ser. No. 09/803,868, filed Mar. 12, 2001 now U.S. Pat. No. 6,652,339, which is a continuation-in-part of U.S. application Ser. No. 09/049,648, filed Mar. 27, 1998 now U.S. Pat. No. 6,200,026, which claims the benefit of U.S. Provisional Application No. 60/042,201 filed Mar. 31, 1997, all of the above-identified applications are incorporated by reference.

BACKGROUND OF THE INVENTION

1. Field of the Invention

The present invention relates generally to diving and more particular to an inflatable diver marker and collection bag to be utilized by a diver for the collection of lobster, conch, etc., as well as providing for a diver location marker to boats and other water vehicles traveling in the vicinity of the diver.

2. Description of the Prior Art

Many divers carry a collection bag for game, treasure or even trash collecting. One conventional bag is a simple mesh construction having an opening at the top and provided with a conventional "flip-over" latch to keep the top closed. The collection bag is connected to the diver. However, as the diver successfully fills his bag the weight of the catch requires the diver to add air to his or her buoyancy compensator ("BC") in order to offset the ballast created by the collected catch. This increase in air to the BC can create a dangerous situation by adding positive buoyancy to the diver's vest which can create an accelerated buoyant ascent if the ballasted collection bag becomes disconnected from the diver. This scenario may also arise given the fact that most divers remove the collection bag when adding additional material thus necessitating an easy to operate attachment mechanism.

Local, state and federal laws generally require at least one diver per group to carry or tow a dive flag attached to a line and reel for identification of diver location. This requirement presumably lessens the likelihood of a diver being struck by a passing boat, under the assumption that the boat operator will see the dive flag and stay clear of the area. One problem with conventional dive flags are that they are single dimension and can only be seen in certain directions. If a boater is traveling in the exact same or exact opposite direction as the wind, it is virtually impossible for the boater to see the flag and identify it as a diver down flag, until the boat is too close to the diver.

All divers in a group are typically meant to ascend under the flag buoy and utilize the line attached to the dive flag buoy as an ascent orientation guide. With multiple divers trying to ascend on a single line problems often occur. Furthermore, each diver individually towing a line is not a realistic option due to the likelihood of the lines becoming entangled with one another. Furthermore, towing of a dive flag and buoy is also uncomfortable and inhibits the diver's performance and collection abilities. As such, usually the diver who totes the line gets left out of any additional productive activities at depth. Accordingly, conventional dive flags do not afford adequate visual warning when the boat operator is traveling in the same direction as or directly opposed to the wind.

Thus what is needed is a combination inflatable dive marker and collection bag which will allow the marker to be visible from all directions and allow the diver to bring the collected catch to the surface without attachment to the diver. It is therefore to the effective resolutions of the shortcomings in the prior art that the present invention is directed.

SUMMARY OF THE INVENTION

The present invention provides for an inflatable dive marker and collection bag which generally includes a dive flag/inflatable lift bladder and a vented mesh catch bag.

In the preferred embodiment, the closed buoyancy chamber or bladder is inflated with a "no lock" inflator device. An overpressure relief valve reduces the likelihood of overinflation resulting from human error or simple ascent expansion of the buoyancy chamber. The overpressure relief valve acts as a manual deflation device for adjustment at depth or deflation at the surface.

When collecting at depth the diver is able to proportionally offset the ballasting effect of his or her collecting activity by adjusting the amount of air in the bladder by the manual deflation device without altering his or her own personal BC device. Furthermore, a diver can also carry multiple collection bags and simply inflate and send to the surface for retrieval by the tender vessel above or for delayed retrieval later on by the diver him or herself. This feature addresses one of the most common concern of spearfisherman in aggressive shark areas by removing the game from the diver as soon as bagged without having to surface.

The design and inflated shape of the dive marker provides for far better visibility from all directions as opposed to conventional dive flags.

Preferably, the bottom half of the catch/collection bag is bell shaped. The bell shaped design provides for defined corners which lobster and other fish tend to travel to. Thus, when additional lobster, fish, conch, etc., are to be disposed in the bag, the already caught items are disposed down at the bottom of the bag by the corners, instead of the top of the bag where they might escape.

A zipper closure is provided at the bottom of the bag for easy removal of the contents, once the bag is brought unto the vessel or boat. At least a bottom portion of the catch/collection bag is preferably constructed from a vented mesh to provide for better water drainage when removing the bag out of the water and onto the boat.

The present invention allows a diver to carry his or her own marker that can be deployed at the end of a dive from depth and therefore allowing a personal ascent line without relying on another diver's location or timing. A d-ring is preferably provided at the bottom of the collection bag. The diver's individual line reel is preferably attached at one end to the d-ring by conventional means. Accordingly, when the diver wishes to resurface he or she inflates the lift bladder of the dive flag/marker through the "no lock" inflator, which causes the dive marker (top half of the collection bag) to rise to the surface and act as a cylindrical marker. Any catch or other items stored in the collection bag will also rise to the surface and are typically disposed in the bottom half of the collection bag. As one end of the line reel is attached to the d-ring which in turn is attached to the bottom of the collection bag, the diver is provided with his or her own ascent line. Thus, the diver does not have to wait in line with other diver's to travel up a single ascent line.

It is an object of the present invention to provide an inflatable dive marker and collection bag combination.

It is a further object of the present invention to provide a dive marker/flag which is more easily seen in the water as compared to conventional dive markers/flags.

It is yet another object of the present invention to provide an inflatable dive marker and collection bag which can be sent to the surface without the diver.

It is still another object of the present invention to provide an inflatable dive marker and collection bag which can serve as an individual ascent line for a diver.

In accordance with these and other objects which will become apparent hereinafter, the instant invention will now be described with particular reference to the accompanying drawings.

DESCRIPTION OF THE PREFERRED EMBODIMENTS

Figure 1:
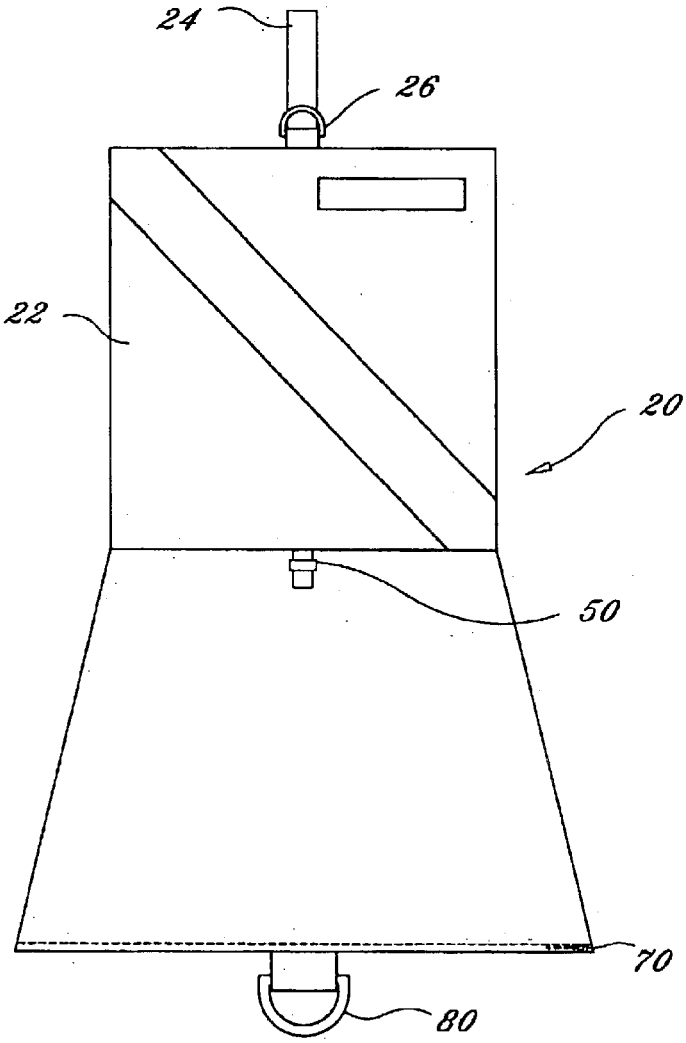
FIG. 1 is a front view of the inflatable dive marker and collection bag in accordance with the present invention.
Figure 2:
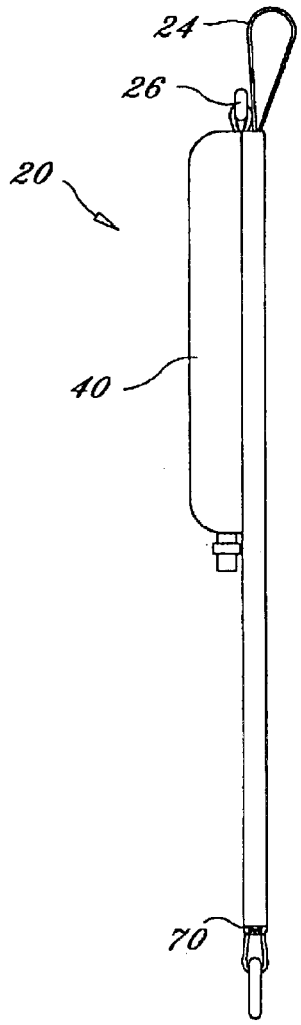
FIG. 2 is a side view of the inflatable dive marker and collection bag shown in FIG. 1.

As seen in the drawings an inflatable dive marker and collection bag is shown with the collection bag generally designated as reference numeral 20 and the conventional dive marking symbol shown as indicia 22 on a top portion of collection bag 20. Collection bag 20 extends from the top end to a bottom end. The top end is provided with a hook and loop fastening members on both sides of the inside surface of collection bag 20 near the top end. The hook and loop fastening member are provided for keeping the top end closed.

A handle 24, preferably in the form of strap forming a loop, is provided to release the hook and loop fastening attachment to allow access to the collection bag for insertion of lobster, conch, fish, shells, treasure, etc. In use, the collection bag is attached to the diver by conventional means, preferably connected to d-ring 26 disposed at the top end of collection bag 20. The diver grabs handle 24 with one hand to open the top end of collection bag and inserts or drops the collected item (i.e. lobster, conch, etc.) into the collection bag with the other hand. Once the item has been inserted, the diver lets go of handle 24. A spring-like member (not shown) is also provided at the top end of collection bag 20, to quickly cause the sides of collection bag 20 at the top end, to quickly come together and remain attached by the hook and loop fastening members. Thus, the top end is preferably spring loaded and remains securely closed, until the diver grabs handle 24 to again break the hook and loop fastening attachment as described above.

An inflatable bladder member 40 is provided on one side of the top portion of collection bag 20. In the preferred embodiment a "no lock" inflator 50 is provided for filling bladder 40 with the desired amount of gas. In this embodiment, bladder 40 is a closed buoyancy chamber. The inflation of bladder 40 to an appropriate level will cause the dive marker/collection bag 20 to ascend to the surface. To inflate bladder 40, the diver manually maintains the auxiliary air hose (not shown) from his or her buoyancy compensator (not shown) onto inflator 50, to allow gas to travel through a one-way valve in inflator 50 into bladder 40. For safety purposes, no actual connection is made between inflator 50 and the auxiliary air hose, and if the diver releases his or her hands from auxiliary air hose, the air hose will become detached from inflator 50.

Once the air hose is detached, air does not escape from bladder 40 in view of the one-way valve within inflator 50. However, to prevent too much air or gas being pumped into bladder and possibly damaging bladder 50, a conventional overpressure relief valve (not shown) can be associated with bladder 50. Overpressure relief valve can be set to a certain level (i.e. 2 p.s.i.). Thus, any amount of air or gas, within the bladder, over the set level will be discharged through overpressure relief valve.

The overpressure relief valve reduces the likelihood of overinflation resulting from human error or simple ascent expansion of the buoyancy chamber. The overpressure relief valve also acts as a manual deflation device for adjustment at depth or deflation at the surface.

Though not preferred, in lieu of inflator 50 a small opening can be provided at the bottom of bladder 40, where inflator is normally disposed. The opening can be closed by hook and loop fastening means. A small strap handle, which can have a d-ring attached at an outer end, is provided to release the close attachment of the hook and loop fastening means in order to provide access within bladder 40. To inflate bladder 40, the diver takes his or her regulator and positions the regulator at the small opening to direct air or gas into bladder. Due to the position of bladder 40 and gravity, the directed air will rise to the top of bladder 40, causing the dive marker/collection bag 20 to rise to the surface, with the dive marker portion of collection bag 20 protruding upwards out of the water for a certain amount of time.

As discussed above, while the diver is traveling underwater in search of lobster, conch, treasure, etc. collection bag 20 can be removably attached to the diver by conventional means associated with d-ring 26. However, before collection bag 20 is attached to the diver, air or gas should be slowly added to or remove from bladder 40, as described above, in order to ensure collection bag 20 is neutrally buoyant. Thus, where bag 20 is neutral, attaching such bag to the diver will not cause the diver to unintentionally ascent, which could cause injury to the diver. Furthermore, after each time an item or items (i.e. lobster) are disposed within bag 20, bag 20 should be detached from the diver and checked to ensure that bag 20 is neutrally buoyant. The addition of the collected items within bag 20 can create additional ballast (weight) which may require additional air or gas be directed into bladder 40 to offset the additional ballast, in order to keep bag 20 neutral.

Thus, when collecting at depth the diver is able to proportionally offset the ballasting effect of his or her collecting activity by adjusting the amount of air in bladder 40 by the manual deflation device (overpressure relief valve) without altering his or her own personal BC device.

Preferably, the bottom half or portion of collection bag 20 is bell shaped. The bell shaped design provides for defined corners which lobster and other fish tend to travel to. Thus, when additional lobster, fish, conch, etc., are to be disposed in collection bag 20, the already caught items typically will be disposed down at the bottom of the bag by the corners, instead of the top of bag 20 where they might escape.

A zipper closure 70 is provided at the bottom of collection bag 20 for easy removal of the contents, once bag 20 is brought unto the vessel or boat. At least a bottom end portion of collection bag 20, adjacent zipper 70, can be preferably constructed from a vented mesh (similar to the vented mesh illustrated in FIGS. 6 and 8) to provide for better water drainage when removing the bag out of the water and onto the boat. Thus, the total weight of bag 20 and the collected items is reduced for lifting purposes.

The present invention allows a diver to carry his or her own marker that can be deployed at the end of a dive from depth and also allowing for a personal ascent line without relying on another diver's location or timing. A d-ring 80 is preferably provided at the bottom of collection bag 20. The diver's individual line reel is preferably attached at one end to d-ring 80 by conventional means. Accordingly, when the diver wishes to resurface he or she inflates lift bladder 40, as described above, which causes the dive marker/collection bag 20 to rise to the surface and with the top half or portion of bag 20 protruding upwards out of the water and acting as a cylindrical marker. The design and inflated shape of the top portion of collection bag 20, which is provided with an outer surface having indicia representing a conventional dive marker, provides for far better visibility from all directions as opposed to conventional single dimension dive flags.

Any catch or other items stored in the collection bag will also rise to the surface and are preferably disposed within the bottom half or portion of collection bag 20. As one end of the line reel is attached to d-ring 80 which in turn is attached to the bottom of collection bag 20, the diver is provided with his or her own ascent line. Thus, the diver does not have to wait in line with other diver's to travel up a single ascent line. The diver can also carry multiple collection bags 20 and simply inflate, as needed, and send to the surface for retrieval by the tender vessel above or for delayed retrieval later on by the diver. This feature addresses one of the most common concerns of spearfisherman in aggressive shark areas by removing the game from the diver as soon as bagged without the diver having to surface.

When bladder 40 is deflated, collection bag 20 can be easily folded and stored in such position until needed. To maintain bag 20 is such folded position, a first hook and loop fastening strip can be provided on a portion of the outer surface of collection bag 20. The first hook and loop fastening strip mates with a second hook and loop fastening strip disposed on a portion of handle 24.

It should be understood that other conventional connectors can be used or substituted for the d-rings described above and are considered within the scope of the invention. Furthermore, though zipper 70 is preferred, other conventional opening/closing devices can be used or substituted for zipper 70, such as snaps, hook and loop fastening means, buttons, etc.

Figure 4:
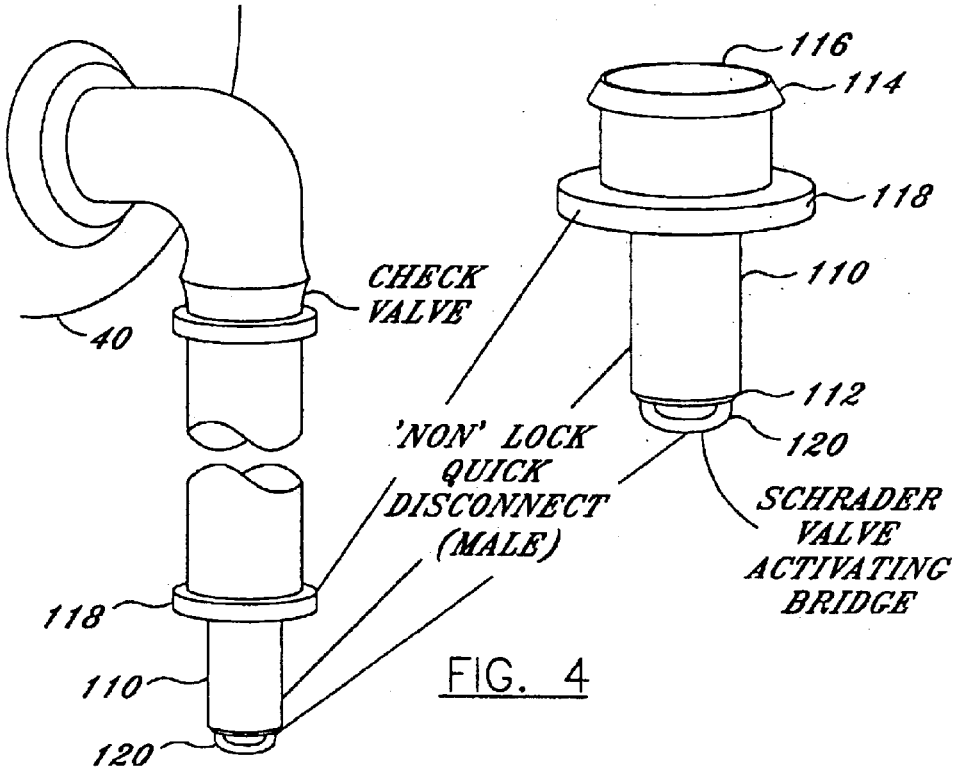
FIG. 4 is a perspective view of a male portion of the quick disconnect member illustrated in FIG. 3.
Figure 3:
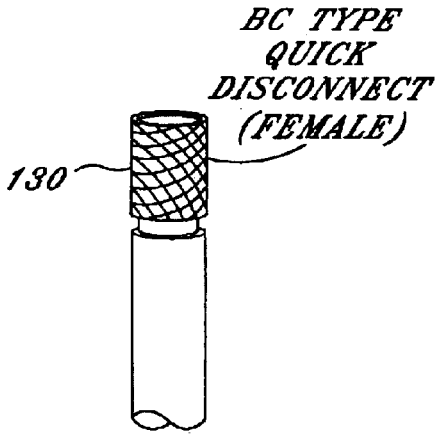
FIG. 3 is a perspective view of a quick disconnect member in accordance with the present invention.

A preferred embodiment for "no-lock" valve 50 is shown in detail in FIGS. 3 and 4 which illustrate a quick disconnect connector embodiment generally designated as connector 100. Connector 100 generally includes a male member 110 associated with the bladder device 40 and a female member 130 commonly associated with an inflating hose member of a conventional buoyancy compensator (not shown).

Figure 5:
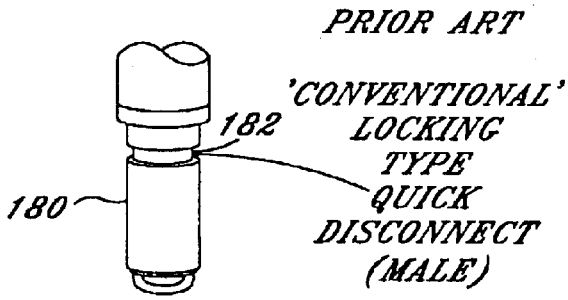
FIG. 5 is a perspective view of a prior art quick disconnect member having its female portion in section.
Figure 5:
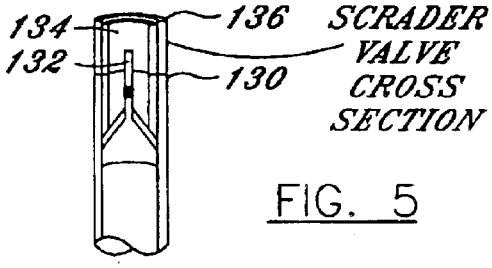

With the use of a conventional connector (FIG. 5), male member 180 is provided with a groove member 182 for a locking attachment with female member 130. Under pressure it is often difficult to release male member 180 from its locking attachment to female member 130.

As seen in FIGS. 3 and 4, conventional male member 180 (FIG. 5) is replaced with a male member 110. Male member 110 includes a first end 112, a second end 114 and an internal passageway 116 extending through said male member 110 from first end 112 to second end 114. Male member 110 is not provided with a groove member to avoid locking problems. Male member 110 can also be provided with an outer circular flange member 118 and a Schrader valve activating bridge member 120. Alternatively, a male member can be provided with a groove, and the bridge member can be sufficiently long so as to not allow the female portion with the ball locking mechanism to reach the ball locking groove in the male portion.

In use, male member 110 is received within internal passageway 134 of female member 130 until flange member 118 abuts an outer first end 136 of female member. Thus, flange member 118 acts as a stop means to properly position the first end of male member 110 within internal passageway 134 of female member 930. This positioning of male member 110 with respect to female member 130 allows bridge member 120 to activate Schrader valve 132 to allow air to flow within a flotation chamber of bladder 40.

Male member 110 is slightly smaller in outer diameter as compared to the inner diameter of internal passageway 134. This allows male member 110 to be snugly and tightly received and maintained within internal passageway 134 of female member 130, while at the same quickly and easily releasable. Lastly, outer flange member 118 also serves as a gripping means to quickly remove male member 110 from within internal passageway 134 of female member 130 once bladder 40 is properly inflated or in the event of an emergency.

Figure 6:
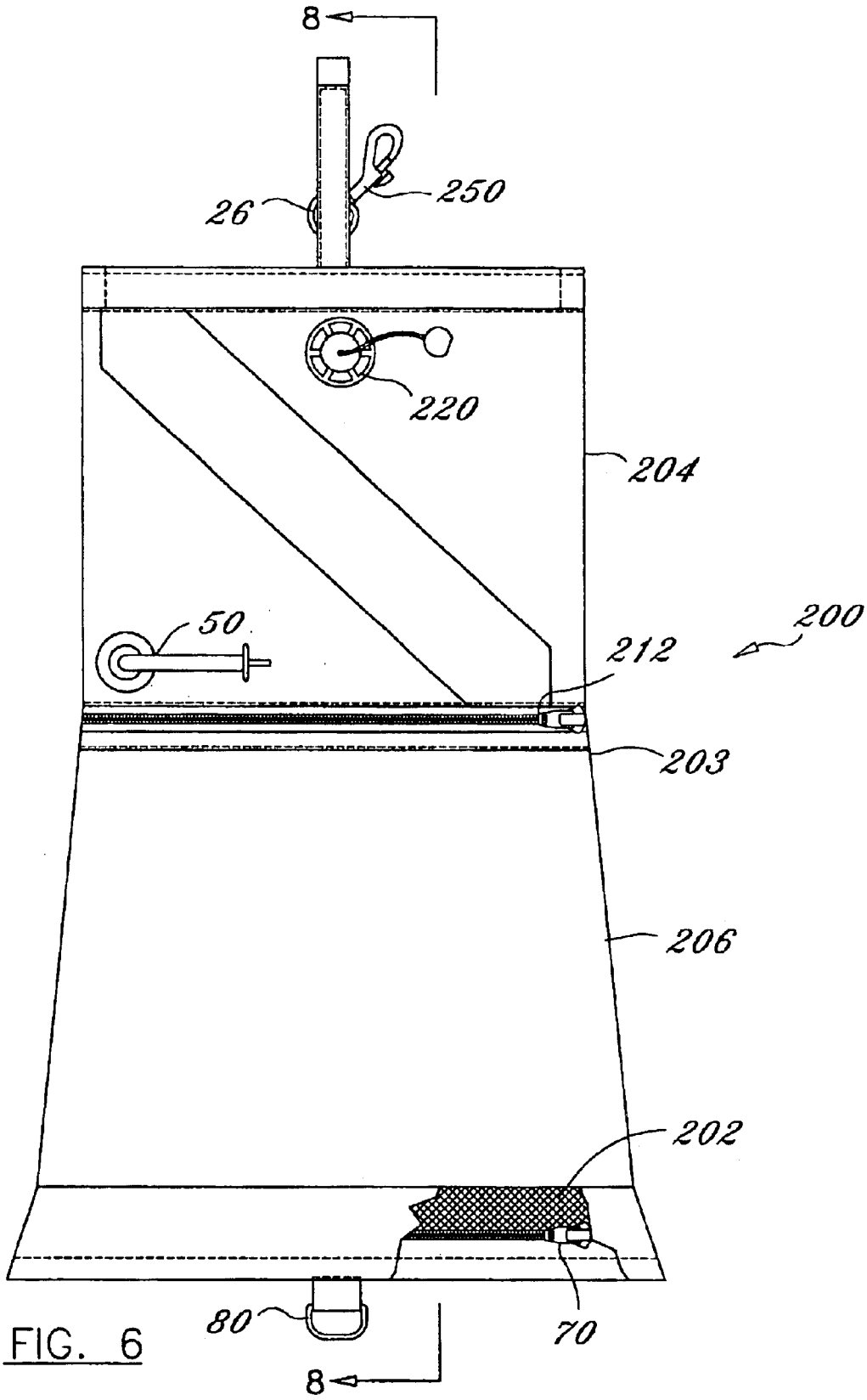
FIG. 6 is a front elevational view of an alternative embodiment for the inflatable dive marker and collection bag in accordance with the present invention.
Figure 7:
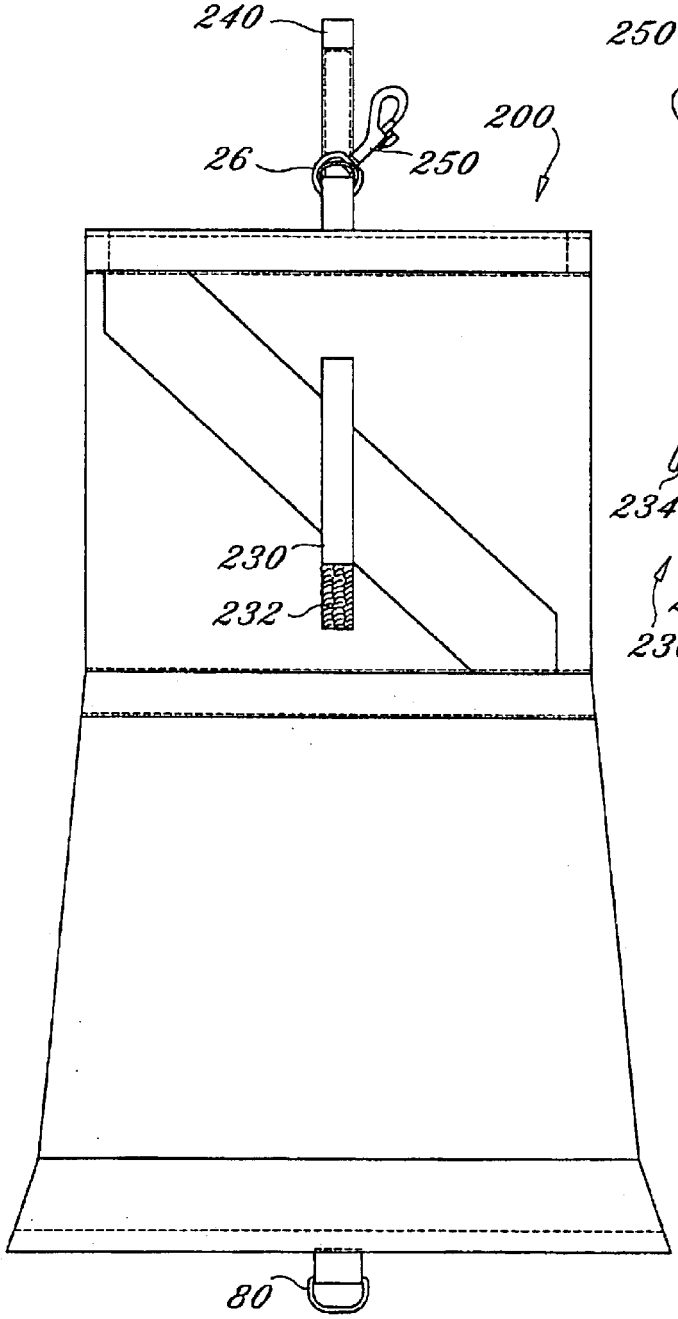
FIG. 7 is a back elevational view of the alternative embodiment illustrated in FIG. 6.
Figure 8:
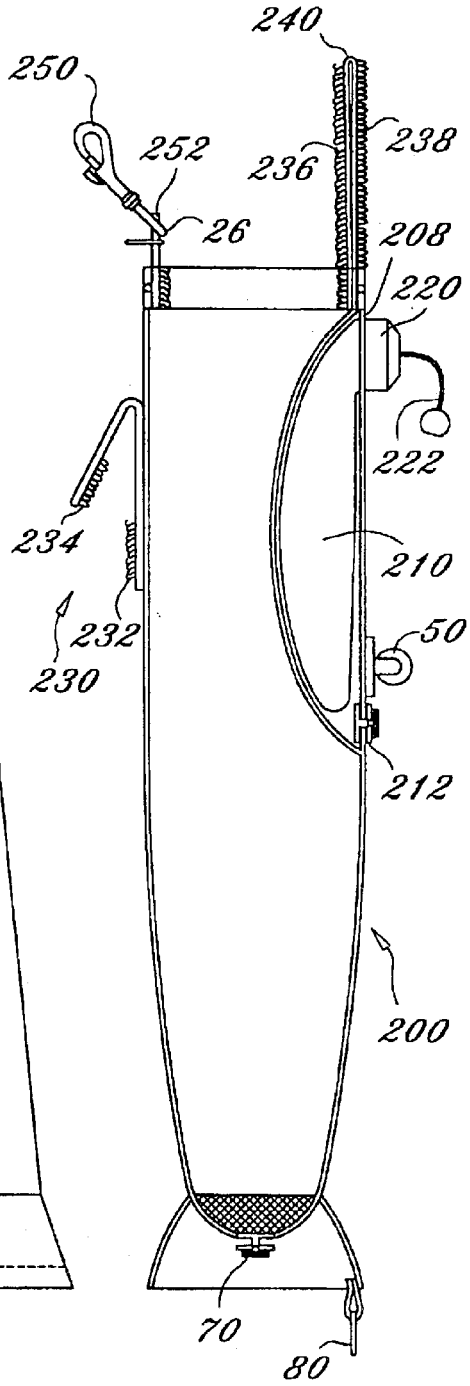
FIG. 8 is a sectional view taken along section lines 8—8 of FIG. 6.

FIGS. 6 through 8 illustrate an alternative embodiment for the dive marker/collection bag, which is generally designated as reference numeral 200. Collection bag 200 is very similar to collection bag 20 and only the differences will be discussed below. The bottom of collection bag 200 is preferably provided with vented mesh material 202, which is also provided with collection bag 20 but was not previously illustrated. The collection area consist of a body member 203 having a top portion 204 and a bottom portion 206. Adjacent to top portion 204 is a bladder receiving area 208. An inflatable bladder 210 is preferably removably disposed within receiving area 208. However, it is also within the scope of the invention that bladder 210 is permanently attached within receiving area 208 or is constructed from part of top portion 204. Preferably, receiving area 208 is closed by a zipper assembly 212, however other closure mechanisms such as, but not limited to, hook and loop fasteners, buttons, snaps, etc., can also be used and are considered within the scope of the invention.

When disposed within receiving area 208, bladder 210 is in communication with "no-lock" valve 50 and "overpressure relief" valve 220, which are also provided with collection bag 20. Overpressure relief valve 220 serves two purposes. First, valve 220 allows for manually activation, through pull cord 222 attached to a gasket seal, to manually reduce volume of gas contained within bladder 210. Secondly, valve 220 automatically prevents bladder 210 from rupturing from overexpansion. Once a predetermined value is reached, such as, but not limited to, 1 to 5 p.s.i., the gasket normally resting or abutting a seat member to create a seal, through a spring mechanism, moves or detaches from its sealed position, to allow gas to escape until the value reaches or falls below the predetermined value (i.e. 2 p.s.i.) again. The gasket can be rubber, though such is not limiting. Overexpansion can occur from two situations:(1) where the user applies too much gas into bladder 210 such that the predetermined value is reached, or (2) though the release of collection bag to sent to surface, the gas disposed within bladder 210 expands upon ascent.

A strip 230 is partially attached to top portion 204 and is provided with a first hook and loop fastening material 232 on its attached section and a mating second hook and loop fastening material 234 on its non-attached section. Hook and loop fastening materials 232 and 234 are provided for mating with hook and loop fastening materials 236 and 238 on strap/handle 240 when collection bag 200 is rolled up to maintain bag 200 in its rolled up position until needed. A bolt snap 250 can also be provided and attached to collection bag 200 by a strap 252 or other conventional means. Collection bag 200 is used similar to collection bag 20.

Figure 10:
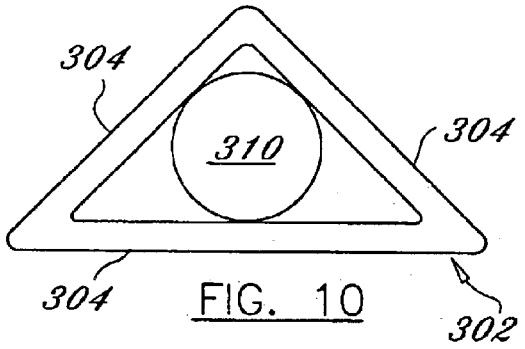
FIG. 10 is a top view of the inflatable dive marker of FIG. 9.
Figure 11:
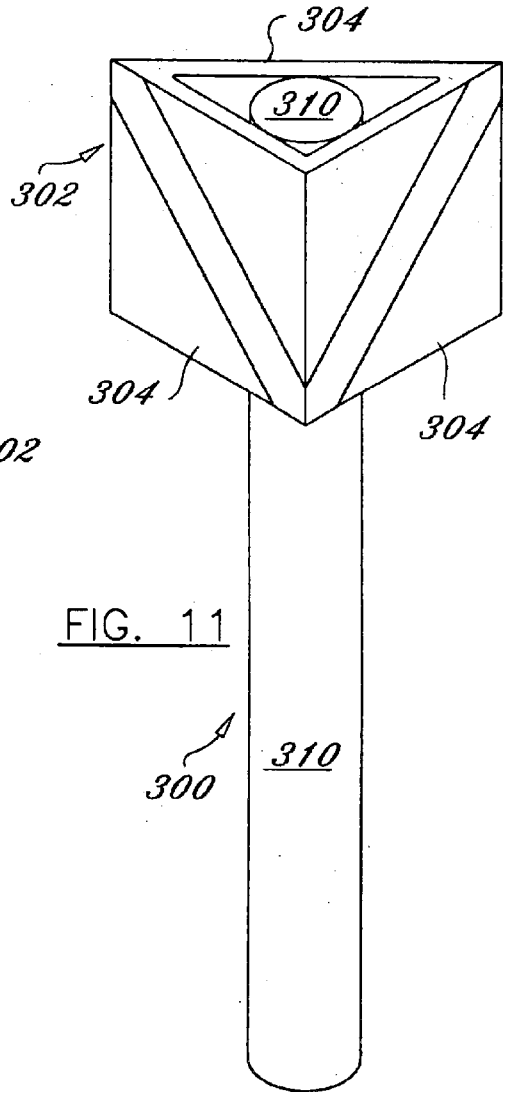
FIG. 11 is a perspective view of the inflatable dive marker of FIG. 9.
Figure 9:
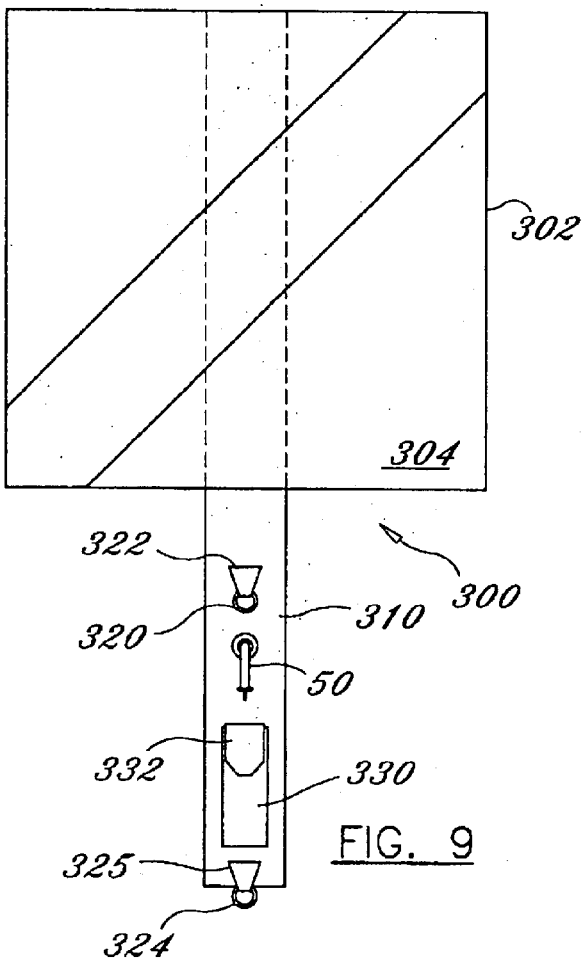
FIG. 9 is a front elevational view of a first inflatable dive marker embodiment in accordance with the present invention.

FIGS. 9 through 11 illustrate a first inflatable dive marker embodiment which is generally designated as reference numeral 300. Dive marker 300 includes a body member 302 and a post member 310, with post member 310 preferably centrally located. Body member 302 is provided with either three (as shown) or four surfaces 304 which resemble conventional dive marker indicia. Preferably all outer surfaces of body member 302 are provided with dive marker indicia, though such is not limiting. Additionally, the various outer surfaces can be provided with other types of indicia. Body member 302 and post member 310 both include inflatable chambers which can be in communication to form one large chamber or separate chambers. The dive marker or other indicia can be provided by any known means, including painting, silkscreening, dyes, fabric colors, etc.

Where one large chamber, one overpressure relief valve similar to valve 220 can be provided on either body member 302 or post member 310. Likewise, a single inflation member, such as a "no-lock" valve similar to "no-lock" valve 50, can be provided on either body member 302 or post member 310. Where separate chambers are provided, body member 302 and post member 310, are both provided with associated with overpressure relief valves and inflation mechanisms, such as "no-lock" valves. It is also within the scope of the invention that each surface of body member 302 is provided with a separate chamber, thus, also having separate overpressure relief valve and inflation mechanism.

A tow-line ring 320, or other attachment mechanism, can be provided and preferably attached to post member 310 by strap 322. An equipment attachment ring 324 (i.e. for attaching a collection bag) can be provided and is preferably attached to post member 310 by strap 325. A counterweight pocket 330 can be provided and is preferably attached to post member 310 by conventional means such as stitching or sewing. Pocket 330 is preferably provided with a flap 332 which is maintained in a closed position (FIG. 9) through conventional means, such as, but not limited to, a side release buckle, other buckles, hook and loop fastening members, snap assembly, button and buttonhole assembly, etc. Any ballast material can be used as the counterweight retained within pocket 330, and can include, but not limited to, lead, sand, rock, metal, etc.

Preferably, though not limiting, body member 302 and post member 310 can be constructed from the same material, which can be, but is not limited to, a urethane coated nylon. Preferably, but also not limiting, body member 302 and post member 310 are attached to each other such as by welding, sewing, stitching, riveting, bolting, mechanically fastening with tabs, etc.

Dive marker 300 provides a pneumatic structure. The inherent buoyancy nature of post member 310 causes a portion of post member to be disposed under surface level to compensate for any added ballast. The inflatable nature of dive marker 300 causes it to be a rigid structure.

Figure 13:
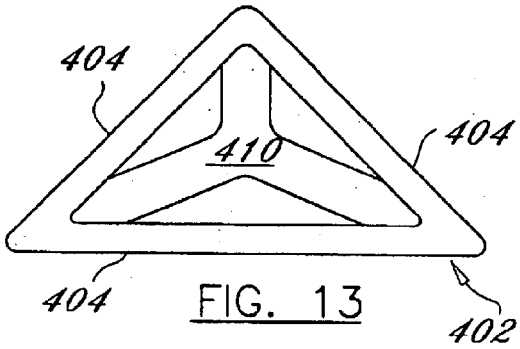
FIG. 13 is a top view of the inflatable dive marker of FIG. 12.
Figure 14:
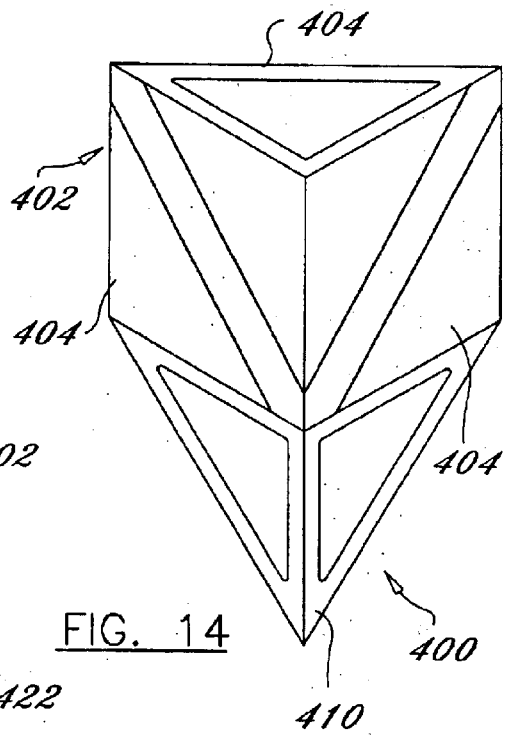
FIG. 14 is a perspective view of the inflatable dive marker of FIG. 12.
Figure 12:
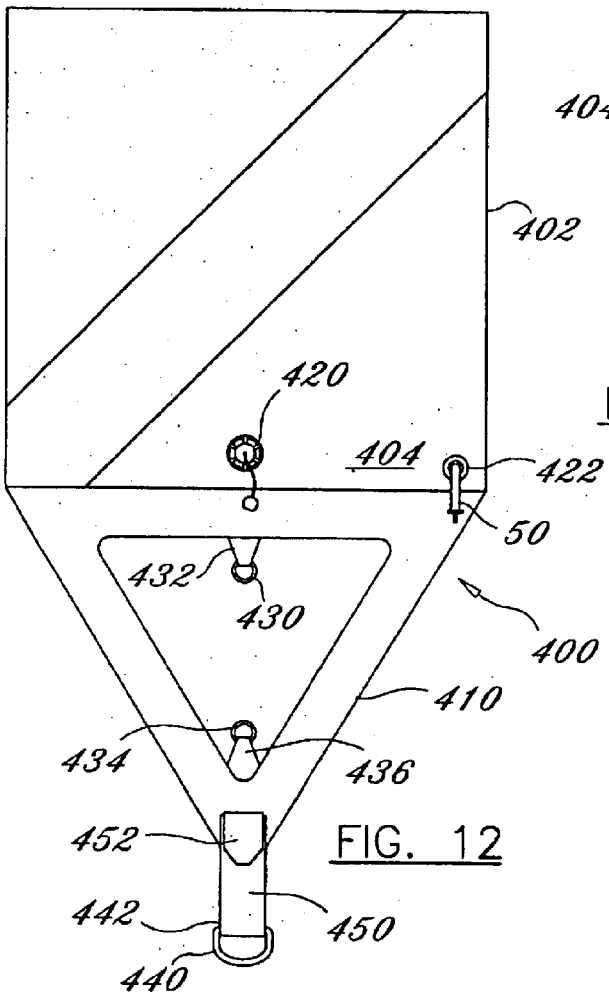
FIG. 12 is a front elevational view of a second inflatable dive marker embodiment in accordance with the present invention.

FIGS. 12 through 14 illustrate a second inflatable dive marker embodiment which is generally designated as reference numeral 400. Dive marker 400 includes a body member 402 and a lower member 410, with lower member preferably pyramid shaped (i.e. inverted pyramid). Body member 402 is provided with either three (as shown) or four surfaces 404 which resemble conventional dive marker indicia. Preferably all outer surfaces of body member 402 are provided with dive marker indicia, though such is not limiting. Additionally, the various outer surfaces can be provided with other types of indicia. Body member 402 and lower member 410 can both include inflatable chambers which can be in communication to form one large chamber or separate chambers. The dive marker or other indicia can be provided by any known means, including painting, silkscreening, dyes, fabric colors, etc. Lower member 410 can also be non-inflatable. Whether inflatable or non-inflatable, lower member 410 is preferably constructed from a webbing material, though other materials could be used and are considered within the scope of the invention. An overpressure relief valve 420 and a no-lock valve 422 are preferably provided similar to dive marker 300.

A high tow-line ring 430, or other attachment mechanism, can be provided and preferably attached to lower member 410 by strap 432. A low tow-line ring 434, or other attachment mechanism, can be provided and preferably attached to lower member 410 by strap 436. It should be recognized that the non-used tow ring 430 or 434 can also be used to attach any other desired item. An equipment attachment ring 440 (i.e. for attaching a collection bag) can be provided and is preferably attached to lower member 410 by strap 442. A counterweight pocket 450 can be provided and is preferably attached to lower member 410 by conventional means such as stitching or sewing, preferably, though not limiting, adjacent to strap 442. Pocket 450 is preferably provided with a flap 452 which is maintained in a closed position (FIG. 12) through conventional means, such as, but not limited to, a side release buckle, other buckles, hook and loop fastening members, snap assembly, button and buttonhole assembly, etc. Any ballast material can be used as the counterweight retained within pocket 450, and can include, but not limited to, lead, sand, rock, metal, etc.

Preferably, though not limiting, body member 402 and lower member 410 can be constructed from the same material, which can be, but is not limited to, a urethane coated nylon. Preferably, but also not limiting, body member 402 and lower member 410 are attached to each other such as by welding, stitching, sewing, riveting, bolting, mechanically fastening with tabs, etc. Depending on whether lower member 410 is also inflatable, will determine whether a portion of lower portion also extends above the water level. The inflatable nature of at least body member 402 causes it to be a rigid structure. Additionally, the preferred pyramid shaped of lower member 410 allows the counterweight to be centrally positioned to help maintain the desired upright position of dive marker 400 during use.

Figure 15:
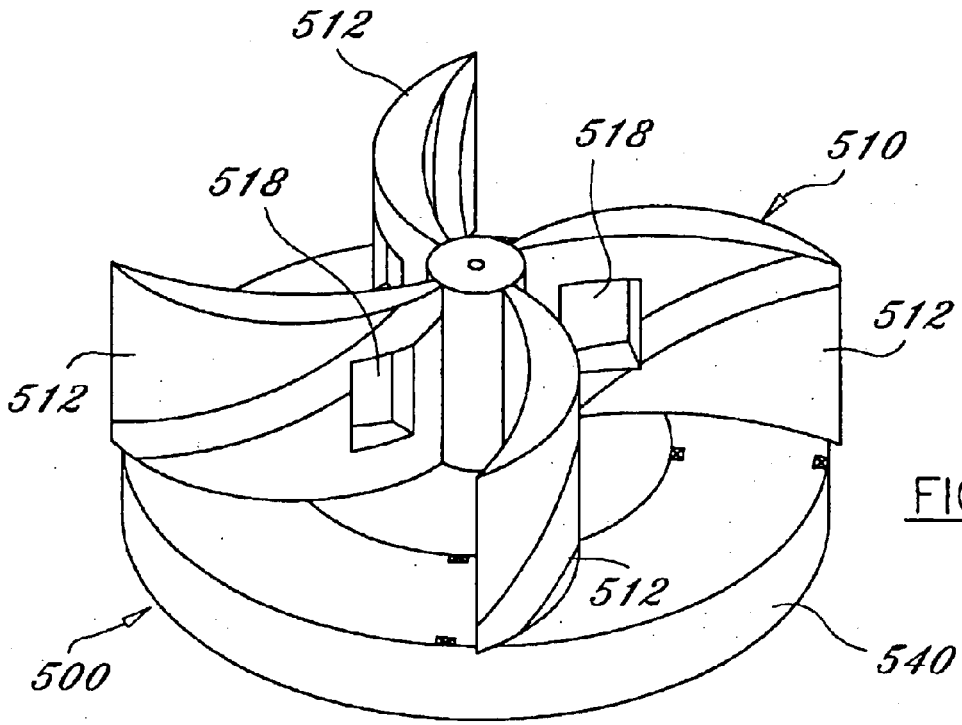
FIG. 15 is a perspective view of a third inflatable dive marker embodiment in accordance with the present invention.
Figure 16:
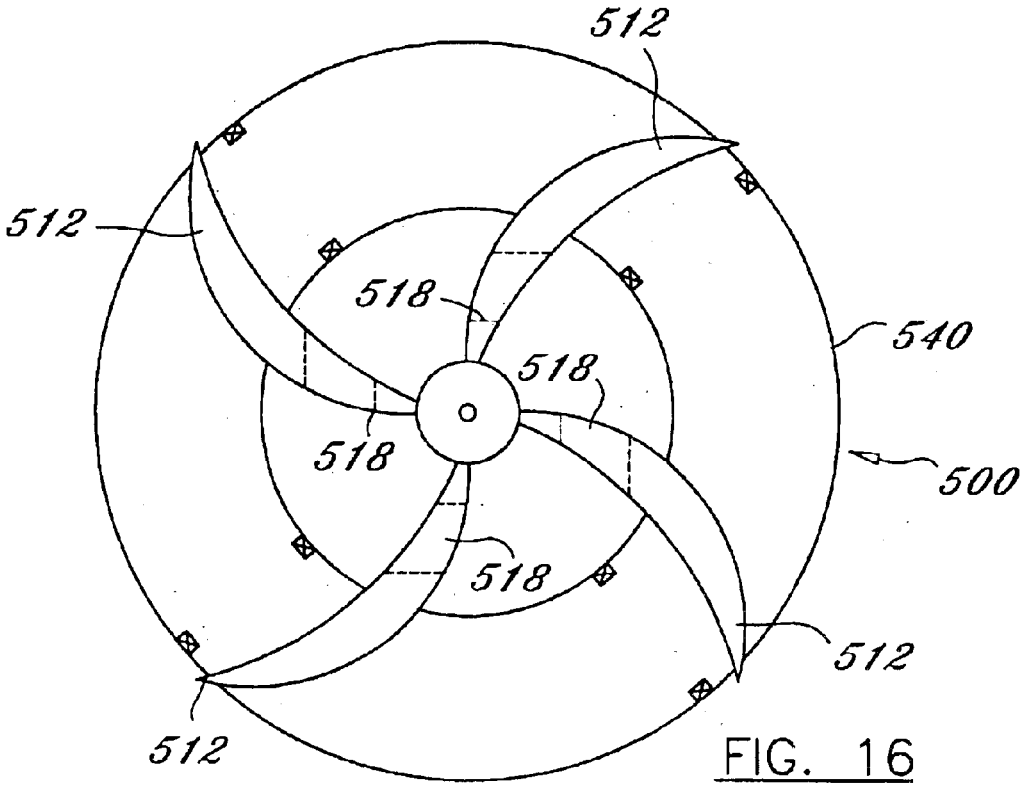
FIG. 16 is a top view of the inflatable dive marker of FIG. 15.
Figure 17:
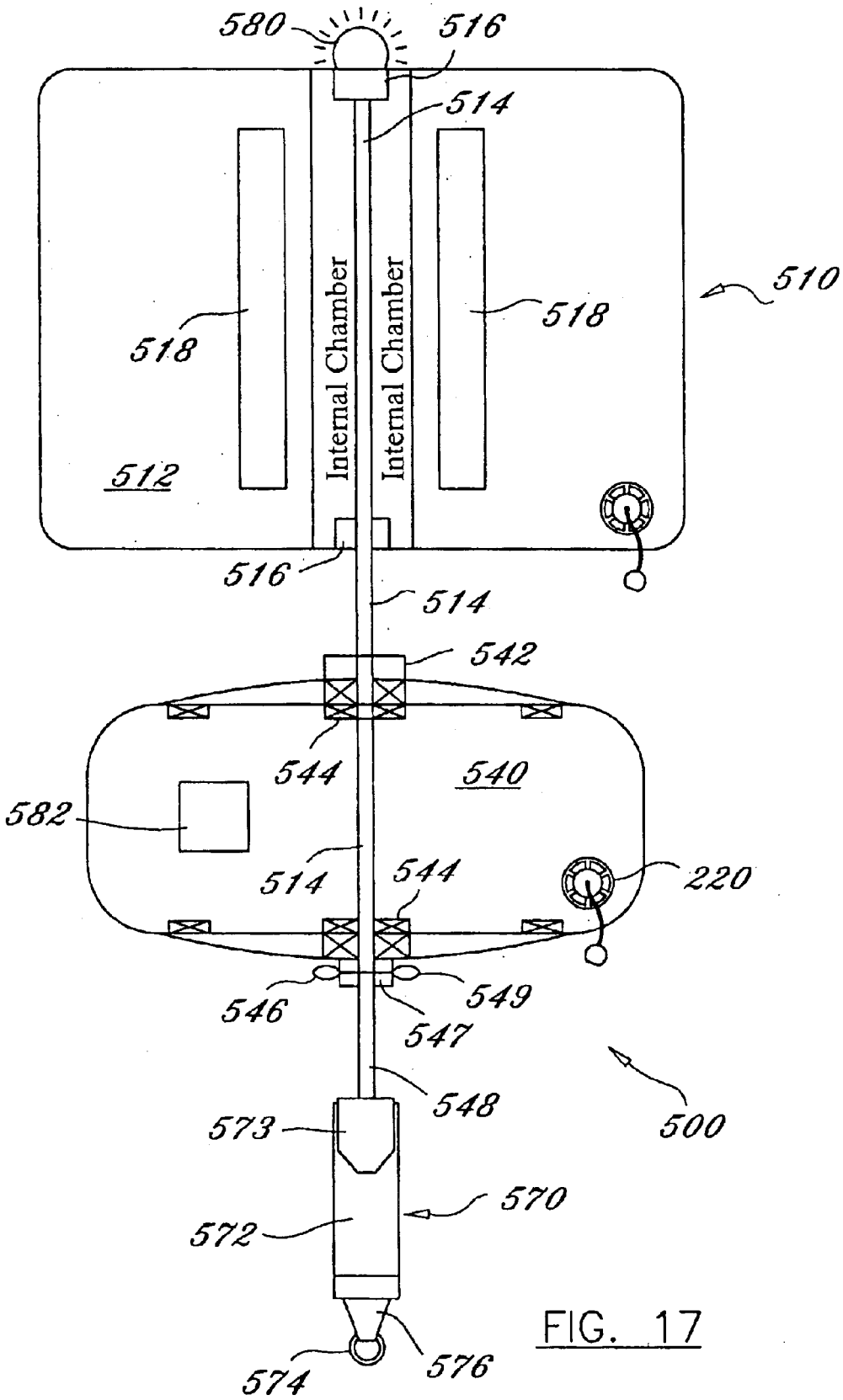
FIG. 17 is a front elevational view of the inflatable dive marker of FIG. 15.

FIGS. 15 through 17 illustrate a third inflatable dive marker embodiment which is generally designated as reference numeral 500. Dive marker 500 includes an inflatable vane assembly 510, an inflatable flotation device or platform 540 and also preferably a counterweight assembly 570.

Vane assembly 510 consists of three of four rotating vanes 512 rotatably disposed around an inner shaft 514. Shaft 514 is preferably constructed from plastic, though such is not considered limiting. A pair of bearings 516 or other retaining members maintain vane assembly 510 in position along shaft 514. A top end of vane assembly 510 is attached to top bearing 516 and the lower end of vane assembly 510 is attached to bottom bearing 516. Both sides of each vane 512 can be provided with dive indicia or other indicia, though such is not limiting. Preferably, the entire vane assembly consists of one large inflatable chamber, having a single inflation mechanism and overpressure relief valve. However, it is also within the scope of the invention that each vane has its own inflatable chamber, which would require additional inflation mechanisms (i.e. no-lock valve) and overpressure relief valves. Preferably, each vane 512 is constructed from urethane coated nylon, though such is not considered limiting. Bearings 516 ride along shaft 514 and preferably constructed from polymer, though such is not considered limiting. The wind's energy spins vane assembly 510, along with bearings 516, around shaft 514. The movement of vane assembly enhances visibility, as a viewer, such as boater, sees changing colors (i.e. red or blue and white from dive flag indicia).

Each vane 512 can be provided with a cutout 518 which acts as a baffle. Baffle 518 allows the wind to flow through vanes 512, and prevents the wind from trying to force shaft 514 over. Thus, baffle 518 helps to release wind energy by passing the tilt energy. Baffle 518 also helps to minimize drag and tug on diver and minimizes amount of ballast needed to maintain dive marker 500 in a proper upright position.

Inflatable platform 540 is provided with an inflation mechanism (i.e. no-lock valve) and overpressure relief valve. The position of inflatable platform 540 along shaft 514 is chosen so that vane assembly 510 extends completely out of the water in order to allow vanes 512 to rotate around shaft 514. Platform 540 is attached to shaft 514 through a bearing 542, preferably polymer, and webbing 544 which are attached to the fabric of platform 540, preferably by sewing, stitching or welding, though such is not limiting. Bearing 542 is preferably fixably attached to shaft 514. Shaft 514 can be a single elongated member or multi-piece. A tow-ring 546 is preferably attached at the bottom of platform 540, adjacent a second removable shaft 548. A retainer pin 547, having an additional removable ring 549, can also be provided at the bottom of platform 540, adjacent removable shaft 548, and is used to retain shaft 548. Alternatively, one shaft 514 could extend through the entire device.

Counterweight assembly 570 can be provided at the bottom end of shaft 548 and includes a weight pocket 572 (preferably with flap 573 and means for retaining flap 573 in a closed position similar to marker 300 or 400), counterweight (i.e. lead, sand, rock, etc.) and attachment ring 574 attached to pocket 572 through a strap 576.

A high visibility light 580 can protrude out of and held in place by top bearing 516 to make marker 500 even more visible and particularly during nighttime use. Additionally, each vane 512 can be constructed such that it is semi-translucent (i.e. semi-translucent red or blue fabric) and an inner light chamber can be created within the inner center of vane assembly 510 adjacent shaft 514. High visibility light 580 can also be used to provide full flag illumination by illuminating vanes 512. A chrome plated convex parabolic reflector can be provided within the inner light chamber towards the bottom of vane assembly 510 to shine light received from high visibility light 580 through vanes 512.

Thus, vane assembly 510 provides a visibility enhancing energy releasing rotating multiface flag member and dive marker 500 provides a three or four vaned rotating wind energy releasing visibility enhanced all-directional viewable dive marker device. As an alternative to inflatable, a wire frame can be provided.

Dive marker 500 provide a motion enhanced device designed to attract attention by means of controlled rotation and release and/or partially offset the marker tilting energy of the wind via carefully selected vane type surfaces and apertures in the marker panels. Flotation platform 540 is preferably circular or torpedo shaped, though such is not limiting, and provides additional stability to device 500. Shaft or staff 514 passing through polymer bearings 516 provides salt-water compatible rotation in a continuance of the effort to release wind energy and create additional visual attenuation.

It should be recognized that post member 310, lower member 410 and platform 540 serve as support members for the portions of their respective dive markers having the dive indicia.

All of the various embodiments of the present invention can be provided with a pouch member, preferably waterproof, such as pouch 582, for holding a fishing license, lobster license, other identification papers, etc. Furthermore, a traditional dive flag can all be attached to any of the various embodiments of the present invention, preferably at the top end.

The various dive markers of the present invention provide for enhanced visibility which is achieved through an increased profile. The wider profile is somewhat inherent to the inflatable manufacturing process, which creates a bellow effect. The increased width created provides a safety advantage in high boat traffic regions where divers often surface. The inflatable surface area of the dive marker allows it to be equally visible from all angles and is easy to stow prior to deployment, due to the nature of inflatable structures.

It should be recognized that the "no-lock" valve is the only the preferred inflation mechanism for all of the embodiments of the present invention, but that the invention is not considered limited to "no-lock" valves. Accordingly, various other inflation mechanisms can be used and all are considered within the scope of the invention.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A dive marker, comprising:

a buoyant body member having at least three outer side surfaces, at least a portion of each of said outer side surfaces containing dive flag indicia, said at least three outer side surfaces defining an opening extending from a bottom end of said buoyant body member to a top end of said buoyant body member, means for maintaining said body member in a substantially vertical orientation at water surface level.

2. The dive marker of claim 1 wherein said means for maintaining comprises an inflatable post member having at least top area disposed within or approximate to said opening defined by the at least three outer side surfaces of said buoyant member;

a weight member; and a weight holder, said weight holder attached to a lower area of said inflatable post member, said weight member maintained in position by said weight holder.

3. The dive marker of claim 1 wherein said buoyant body member is inflatable and includes a valve in communication with an interior area of said body member.

4. The dive marker of claim 3 wherein said valve is a "no-lock" valve.

5. The dive marker of claim 3 further including an "overpressure" relief valve in communication with said buoyant body member.

6. The dive marker of claim 3 wherein upon proper inflation of said inflatable body member a majority of the at least three outer side surfaces of said body member containing dive flag indicia expand outward.

7. The dive marker of claim 2 wherein when said post member is inflated a lower portion of said post member is disposed underwater by said weight member and an upper portion of said post member maintains at least a majority of said body member above water surface level.

8. The dive marker of claim 2 wherein said weight holder is an externally located weight receiving pocket attached to an outer lower portion of said post member.

9. A dive marker assembly, comprising:

an inflatable body member having at least three outer side surfaces and having dive indicia disposed on at least a portion of each outer side surface, said at least three outer side surfaces defining an opening extending from a inflatable body member;

a buoyant post member having at least top area disposed within or approximate to said opening defined by the at least three outer side surfaces of said inflatable body member;

an underwater externally accessible weight receiving pocket attached at a lower portion of said buoyant post member; and a weight member disposed within said weight receiving pocket.

10. The dive marker assembly of claim 9 wherein said inflatable body member having a first inflation mechanism in communication with an interior area of said inflatable body member.

11. The dive marker assembly of claim 10 wherein said bouyant post member centrally attached to said inflatable body member within the opening defined by the at least three outer side surfaces.

12. The dive marker assembly of claim 11 wherein said post member is inflatable and has a second inflation mechanism in communication with an interior area of said post member.

13. The dive marker of claim 9 wherein when assembled a lower portion of said post member is disposed underwater by said weight member and an upper portion of said post member maintains at least a majority of said body member above water surface level.

14. A dive marker assembly, comprising:

a vane assembly having a plurality of vanes, at least one of said plurality of vanes having indicia disposed on an outer surface; and a platform;

a shaft member, said platform attached to said shaft and said vane assembly disposed at one end of said shaft; and a light assembly having a light bulb and power source, said light bulb disposed at or approximate to a top end of said shaft member.

15. The dive marker of claim 14 wherein each of said plurality of vanes is inflatable.

16. The dive marker of claim 14 wherein said platform is inflatable.

17. The dive marker of claim 15 wherein said platform is inflatable.

18. A dive marker, comprising:

a buoyant body member having at least three outer side surfaces, at least a portion of each of said outer side surfaces containing dive flag indicia, said at least three outer side surfaces defining an opening extending from a bottom end of said buoyant body member to a top end of said buoyant body member;

a substantially inverted pyramid shaped member attached to a lower end of said buoyant body member such that a majority of said buoyant body member is maintained above water surface lever;

an externally located weight holder attached to a lower end of said substantially inverted pyramid shaped member; and a weight member maintained by said weight holder.

19. The dive marker of claim 18 wherein said buoyant body member is inflatable and includes a valve in communication with an interior area of said body member.

20. A dive marker assembly, comprising:

an inflatable vane assembly having indicia disposed on an outer surface; and means for maintaining at least a majority of said inflatable vane assembly above water surface level;

wherein said means for maintaining is an inflatable platform and shaft member, said platform attached to said shaft and said vane assembly disposed at one end of said shaft; and a light assembly having a light bulb and power source, said light blub disposed at or approximate to a top end of said shaft member wherein said platform is independent from said inflatable vane assembly.

* * * * *